United States Patent [19]

Lorincz et al.

[11] Patent Number: 4,891,090

[45] Date of Patent: Jan. 2, 1990

[54] TWO-REEL DISPENSER FOR A TRANSFER ADHESIVE

[75] Inventors: Eugene M. Lorincz, Cinnaminson, N.J.; Ronald J. Steele, Wyndmoor, Pa.

[73] Assignee: Moore Push-Pin Company, Wyndmoor, Pa.

[21] Appl. No.: 253,118

[22] Filed: Oct. 4, 1988

[51] Int. Cl.[4] ..... B32B 35/00

[52] U.S. Cl. ..... 156/577; 156/578; 156/579; 156/584

[58] Field of Search ..... 156/584, 579, 577, 527, 156/523, 238, 578, 540

[56] References Cited

U.S. PATENT DOCUMENTS

| | | | |
|---|---|---|---|
| Re. 25,056 | 10/1961 | Fritzinger | 156/523 |
| D. 175,505 | 9/1955 | Larsen | D74/1 |
| D. 178,713 | 9/1956 | Williams | D74/1 |
| D. 180,488 | 6/1957 | Larson | D74/1 |
| D. 180,527 | 6/1957 | Polster | D74/1 |
| D. 280,738 | 9/1985 | Grassi | D19/68 |
| 466,923 | 1/1892 | Price | 74/437 |
| 474,629 | 5/1892 | Coe | 156/577 |
| 2,399,925 | 5/1946 | Hewlett | 74/437 |
| 2,436,231 | 2/1948 | Schellens | 172/278 |
| 3,274,038 | 9/1966 | Karn | 156/247 |
| 3,339,797 | 9/1967 | Knutson | 221/73 |
| 3,399,100 | 8/1968 | Rothenberger | 156/523 |
| 3,509,000 | 4/1970 | Brown | 156/584 |
| 3,839,127 | 10/1974 | Hazuka | 156/577 |
| 3,902,956 | 9/1975 | Thompson | 156/577 |
| 3,969,181 | 7/1976 | Seabold | 156/577 |
| 4,041,794 | 8/1977 | Belot | 74/462 |
| 4,051,744 | 10/1977 | Oshima | 74/437 |
| 4,108,016 | 8/1978 | Muranishi | 74/462 |
| 4,151,039 | 4/1979 | Lash | 156/584 |
| 4,200,000 | 4/1980 | Fluehmann | 74/437 |
| 4,207,777 | 6/1980 | Fluehmann | 74/462 |
| 4,223,528 | 9/1980 | Vuilleumier | 74/462 |
| 4,321,839 | 3/1982 | Vuilleumier | 74/462 |
| 4,336,097 | 6/1982 | Van Kampen | 156/527 |
| 4,574,030 | 3/1986 | Pilcher | 156/584 |
| 4,576,311 | 3/1986 | Horton et al. | 156/584 |
| 4,653,340 | 3/1987 | LaBate | 74/437 |
| 4,718,971 | 1/1988 | Summers | 156/577 |

OTHER PUBLICATIONS

Moore Push-Pin Co. Brochure—"Tacky Tape", Oct. 1985.

*Primary Examiner*—Michael Wityshyn
*Attorney, Agent, or Firm*—William H. Eilberg

[57] ABSTRACT

This invention is a dispenser for a transfer adhesive. The dispenser is less expensive to manufacture than comparable dispensers of the prior art, because it uses a single reel to perform the functions previously performed by two separate elements. A supply reel feeds a transfer adhesive tape to a take-up reel, which also acts as an applicator roller. The supply and take-up reels are connected together such that rotation of one causes rotation of the other. The user holds the dispenser so that the take-up reel presses firmly against the surface onto which the adhesive is to be applied. As the dispenser is moved along that surface, the take-up reel rotates due to friction, depositing adhesive and causing the supply reel to deliver more tape. The take-up and supply reels can be connected by gears or by a friction drive. If gears are used, they can be of a modified form which allows the take-up reel to drive the supply reel in only one direction. In another embodiment, a pinion gear or a one-way pin allow the supply reel to rotate in only one direction. Thus, if the user accidentally moves the take-up reel in the wrong direction, the supply reel will not create unwanted slack in the tape. In all embodiments, it is preferred to use a slip clutch to compensate for the differences in speeds of rotation of the take-up and supply reels.

37 Claims, 4 Drawing Sheets

Fig. 6
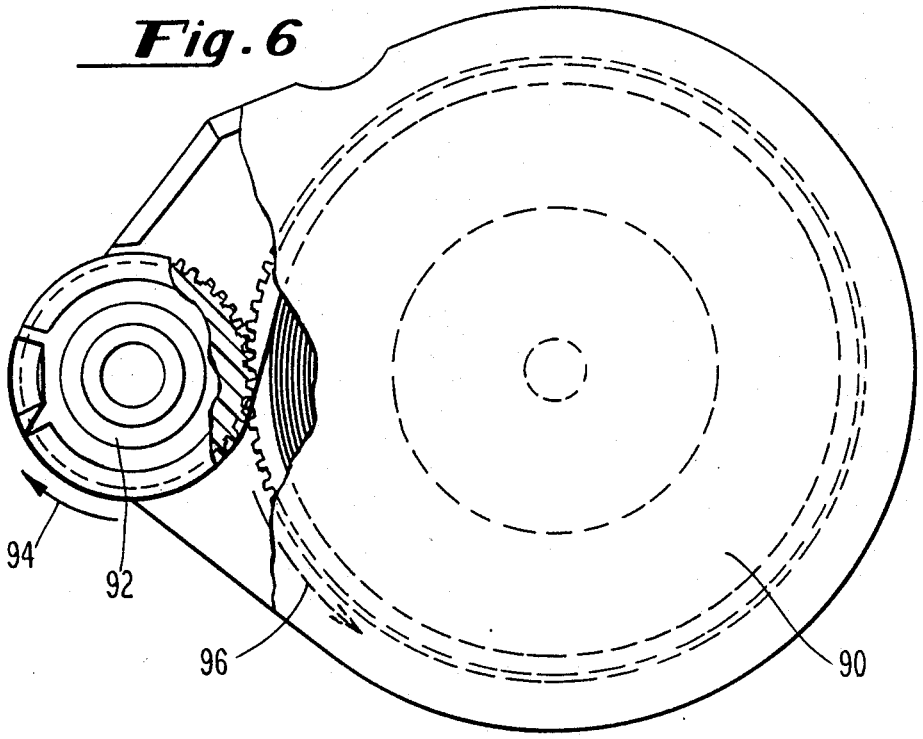
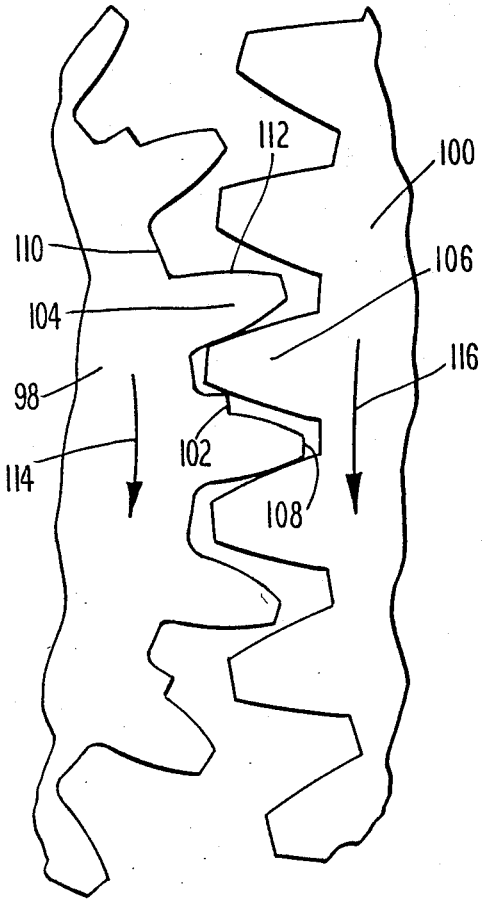
Fig. 7a
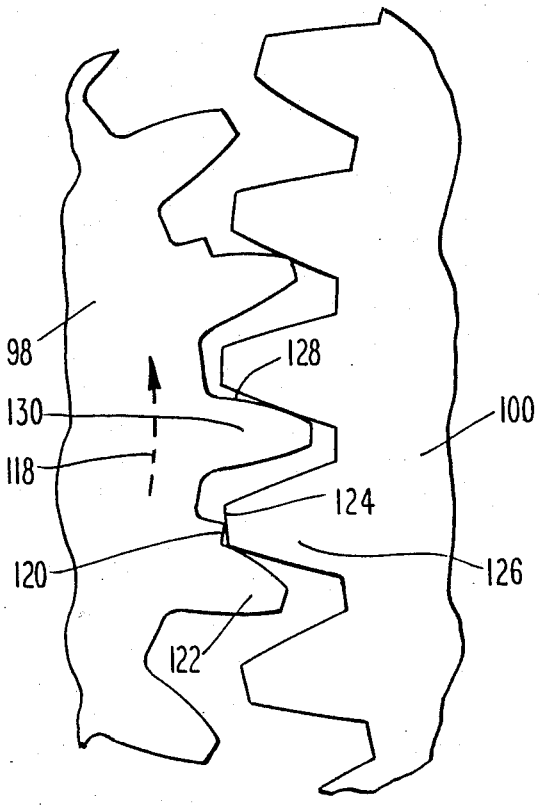
Fig. 7b

TWO-REEL DISPENSER FOR A TRANSFER ADHESIVE

BACKGROUND OF THE INVENTION

This invention is a tape dispenser intended for use in applying a transfer adhesive to a working surface. A dispenser for a transfer adhesive is disclosed in U.S. Pat. No. 4,718,971, owned by the same assignee as that of the present application. The disclosure of the cited patent is incorporated by reference herein.

As used herein, the term "transfer adhesive" means an adhesive which is provided on a non-adhesive backing, and which can be transferred from the backing onto a working surface. Transfer adhesives have many uses. For example, one can apply a strip of transfer adhesive to the surface of a bulletin board, so that paper notes, or similar items, will adhere to the surface. Or one can apply a strip of transfer adhesive directly to a piece of paper, enabling that paper to adhere to other papers or surfaces.

The transfer adhesives described above are usually provided in rolls wound over cores. Transfer adhesives are also used in various manufactured products, such as the self-adhesive note pads sold by the 3M Company under the trademark "Post-It". The dispenser of the present invention, like that shown in U.S. Pat. No. 4,718,971, can be used to convert an ordinary piece of paper into an article which is similar to a "Post-It" note.

Various types of transfer adhesives, and dispensers for transfer adhesives, have been known in the art. For example, U.S. Pat. No. 3,969,181 shows a dispenser for a transfer adhesive having a supply reel, a take-up reel, and an applicator roller. U.S. Pat. No. 3,274,038 shows a dispensing device for a transfer adhesive having a supply reel and a fixed applicator surface around which the tape is drawn. And U.S. Pat. No. 4,336,097 discloses a dispenser for a transfer adhesive, the dispenser having first and second cavities for holding the tape. U.S. Pat. No. 4,718,971, cited above, is another example.

The dispenser of the present invention is not limited to use with any particular formulation of adhesive. The invention can be used to dispense any type of adhesive which is provided in a roll, and which has a backing that must be discarded after the adhesive is used.

One problem with dispensers of the prior art, including that described in U.S. Pat. No. 4,718,971, is the ability of the supply reel to rotate in the undesired direction. If the user tries to apply the transfer adhesive by moving the dispenser in the wrong direction, the supply reel may rotate, and cause considerable unwanted slack in the tape. Indeed, the slack is often serious enough to create a large loop of tape which may be difficult to rewind onto the supply reel. The dispensers of the prior art do not have satisfactory means for insuring that the reels rotate in only the desired direction.

The dispenser of the present invention is an improvement over the dispensers of the prior art, in part because it performs the job of a three-roller dispenser with only two reels. The functions of the take-up reel and applicator roller are performed by the same component. Thus, the dispenser of the present invention is much less expensive to manufacture than a three-reel dispenser, but it does virtually the same job as its more expensive predecessor.

The dispenser of the present invention also has the advantage that it prevents unwanted rotation of the supply reel in the wrong direction. This feature can be accomplished either through a unique modified gear arrangement, or by using a pinion gear or one-way pin to prevent the unwanted rotation. With the present invention, the user need not be concerned with the direction of movement of the dispenser, while applying the transfer adhesive. If the user attempts to move the dispenser in the wrong direction, the supply reel will nevertheless remain stationary.

SUMMARY OF THE INVENTION

The dispenser of the present invention includes two reels, a supply reel and a take-up reel. Both reels are preferably mounted within a housing. The reels are connected together, such that rotation of one reel causes rotation of the other. A tape of transfer adhesive is wound around the supply reel and onto the take-up reel. The tape includes the adhesive itself and a backing material.

When the dispenser is held so that the take-up reel presses against a working surface, and the dispenser is moved along that surface, the take-up reel rotates due to friction. The adhesive on the tape is transferred to the working surface, and the backing is wound onto the take-up reel. The rotation of the take-up reel causes the supply reel to rotate and to supply more tape.

In one embodiment, the take-up and supply reels are connected by gears. The supply reel has a slip clutch which provides frictional engagement of the supply reel and the roll of tape. The slip clutch allows for some slippage, which is necessary to accommodate changes in the relative amounts of tape wound on the two reels. The slip clutch disclosed herein includes a plurality of resilient teeth which press against the inner surface of the roll of tape.

In another embodiment, the drive and clutch mechanisms are combined into one element, namely an O-ring or gasket. The O-ring is mounted around the supply reel, and engages a portion of the take-up reel. The engagement is sufficiently tight to approximate the action of gears, but the material of the O-ring also allows for slippage, as necessary. In the latter embodiment, the supply reel has a set of projections which mate with corresponding indentations in the core of the tape, preventing relative rotation of the core and the supply reel. Thus, in this embodiment, slippage is allowed only by the O-ring.

The invention also includes several means for preventing the supply reel from rotating in the wrong direction. One of these means is a modified gear structure which permits the take-up reel to drive the supply reel in only one direction. In the modified gear, every other tooth defines a step, and the sides of the remaining teeth are cut away.

Still another means of preventing the supply reel from rotating in the wrong direction includes a pinion gear, or a one-way pin. The pinion gear is used when the reels are geared together; the one-way pin can be used when the reels are connected by a friction drive. A wedge-shaped restriction holds the pinion gear, such that the pinion gear becomes stuck in the restriction when one attempts to rotate the supply reel in the wrong direction. The one-way pin operates in essentially the same manner.

Any one of the above-described means for preventing rotation causes the reels of the dispenser to jam or lock when the user attempts to move the dispenser in the wrong direction. This construction reduces the risk of creating unwanted slack in the tape, due to accidental rotation in the wrong direction.

It is therefore an object of the invention to provide an improved dispenser for a transfer adhesive.

It is another object to provide a dispenser for a transfer adhesive, the dispenser having only two reels.

It is another object to combine a conventional take-up reel and applicator roller into one element.

It is another object of the invention to reduce the cost of making dispensers for transfer adhesives, by reducing the number of components required.

It is another object of the invention to provide a two-reel dispenser for a transfer adhesive, wherein one of the reels can drive the other in only one direction.

It is another object to provide a dispenser as described above, wherein the reels are gear-driven, and wherein the gear on the take-up reel is modified so as to permit rotation in one direction only.

It is another object to provide a dispenser as described above, wherein the means of preventing undesired rotation include a pinion element which is trapped in a wedge-shaped restriction when the supply reel rotates in the wrong direction.

It is another object to provide a tape dispenser which reduces the likelihood of unwanted slack in the tape.

Other objects and advantages of the invention will be apparent to those skilled in the art, from a reading of the following brief description of the drawings, the detailed description of the invention, and the appended claims.

BRIEF DESCRIPTION OF THE DRAWINGS

FIG. 6 is a plan view, partly broken away, of another embodiment of the invention, wherein the supply reel and take-up reel are connected by a modified gear drive.

FIGS. 7*a* and 7*b* are fragmentary elevational views of the modified gears of FIG. 6, showing how the take-up reel gear can drive the supply reel gear in one direction only.

DETAILED DESCRIPTION OF THE INVENTION

Figure 1:
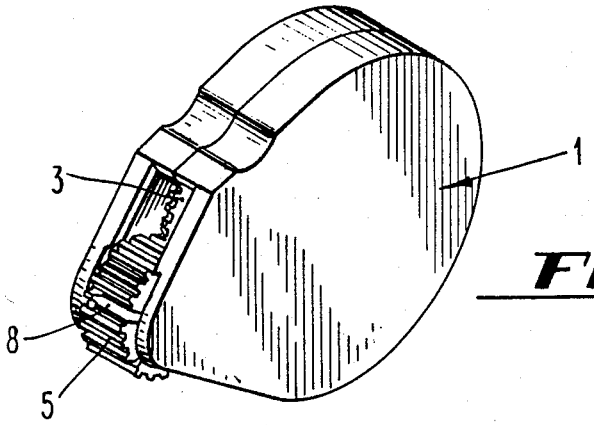
FIG. 1 is a perspective view of a tape dispenser made according to one embodiment of the present invention, showing the dispenser without any tape.
Figure 2:
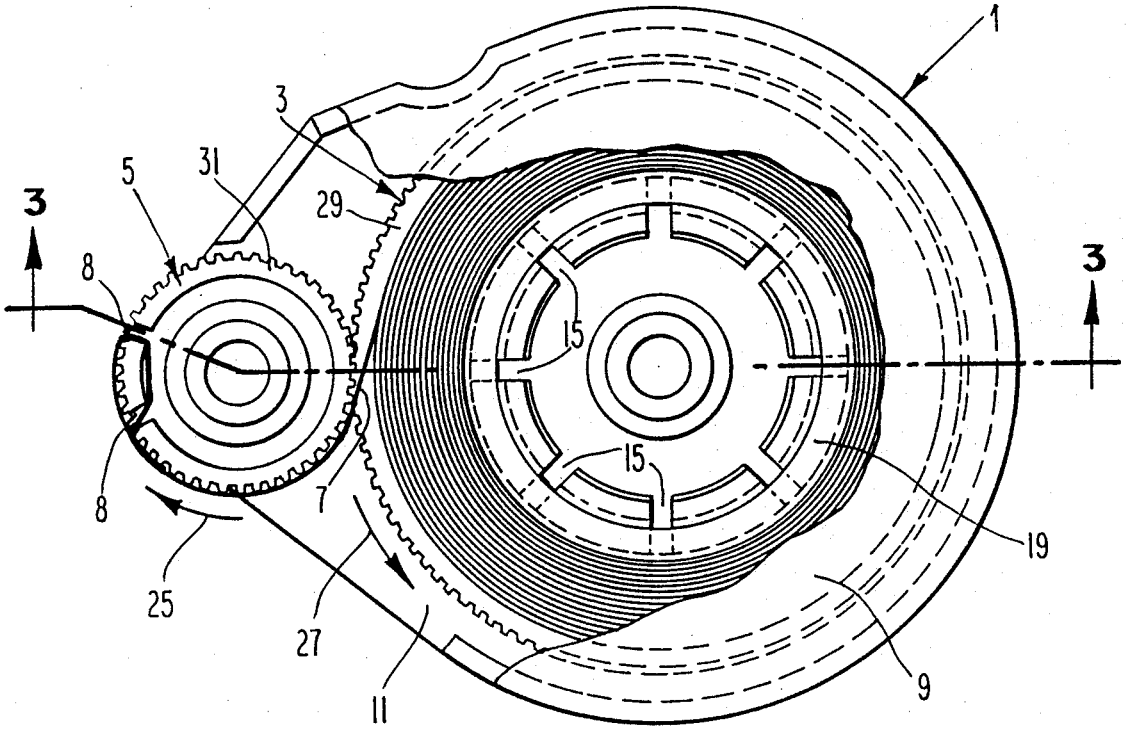
FIG. 2 is a plan view, partly broken away, of the first embodiment of the present invention.
Figure 3:
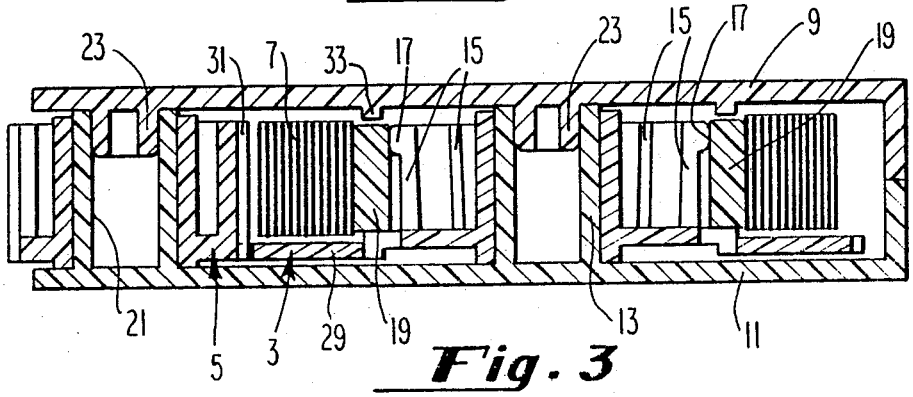
FIG. 3 is a cross-sectional view, taken along the line 3—3 of FIG. 2.

FIGS. 1, 2, and 3 show one embodiment of the two-reel tape dispenser of the present invention. In order to make more of the interior components visible, the perspective view of FIG. 1 shows dispenser 1 without tape. The plan view of FIG. 2 shows these components in greater detail.

Supply reel 3 and take-up reel 5 are connected together, by gears 29 and 31, so that rotation of one reel causes rotation of the other. Transfer adhesive tape 7 is unwound from the supply reel and wound onto the take-up reel, as shown. The transfer tape preferably includes a backing material to which a transfer adhesive is attached. The adhesive and backing are not separately illustrated. The tape is wound around core 19.

Slots 8 in take-up reel 5 facilitate the attachment of tape 7 to the take-up reel. A loop of tape is fastened around the slots, as shown. As the take-up reel rotates, a plurality of layers of spent backing are deposited onto the reel.

In the illustrations of FIGS. 1–3, the take-up reel has gear teeth across its entire width. Thus, the tape backing will be wound around most of the width of these teeth, the remainder of the width being used for geared engagement with the supply reel. However, it is also possible to construct the take-up reel so that the gear teeth extend across only a portion of its width, the remainder of the periphery of the reel being flat. In the latter case, the tape is wound around the flat portion of the take-up reel. Both of these variations are within the scope of the invention.

The take-up reel and supply reel are mounted within a housing which includes top and bottom portions 9 and 11. As shown most clearly in FIG. 3, bottom portion 11 defines bearing 13 for the supply reel. Supply reel 3 also includes a plurality of resilient teeth 15 having heads 17. The teeth and heads are disposed at an angle such that the heads abut the interior surface of core 19 of the roll of tape. Because of the angle of inclination of the teeth and their heads, the heads continually press firmly against the interior surface of the core, and oppose, by friction, the relative rotation of the supply reel and the roll of tape. However, because the roll of tape and the supply reel are engaged by friction only, relative rotation is possible, when the tape is unwound from the supply reel sufficiently rapidly.

The teeth thus comprise a slip clutch for the supply reel and core. The slip clutch holds the roll of tape stationary with respect to the supply reel, except when the take-up reel is demanding additional tape.

Bottom portion 11 of the housing also defines bearing 21 around which take-up reel 5 can rotate. Top portion 9 of the housing includes plugs 23, which fit within bearings 13 and 21. Retaining ring 33 prevents the core from slipping away from the supply reel, especially when the core is rotating relative to the reel.

In operating the dispenser, the user grasps the housing of the dispenser, and holds it so that the take-up roller presses firmly against the surface to which adhesive is to be transferred. If the dispenser shown in FIG. 2 is moved downward, in the plane of the paper, the take-up reel will rotate in the direction indicated by arrow 25, causing the supply reel to rotate in the direction given by arrow 27. The rotating take-up reel also acts as an applicator roller, depositing the transfer adhesive onto the surface.

Because the diameter of gear 29 is much greater than that of gear 31, the take-up reel will rotate more rapidly than the supply reel. Core 19 is therefore pulled around the supply reel, overcoming the friction of heads 17 of teeth 15. Whenever the dispenser is used, the tape is always being pulled by the take-up reel, and there will be no slack in the tape.

Figure 4:
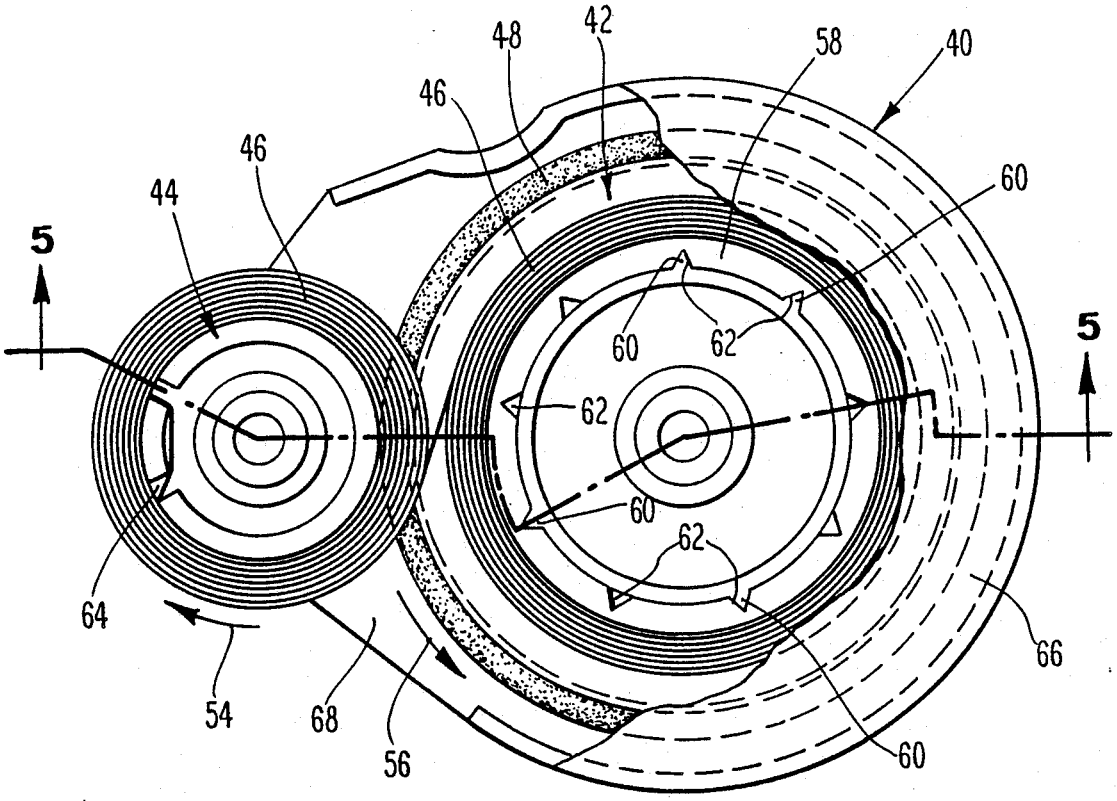
FIG. 4 is a plan view, partly broken away, of a second embodiment of the tape dispenser, wherein the drive means is an O-ring.
Figure 5:
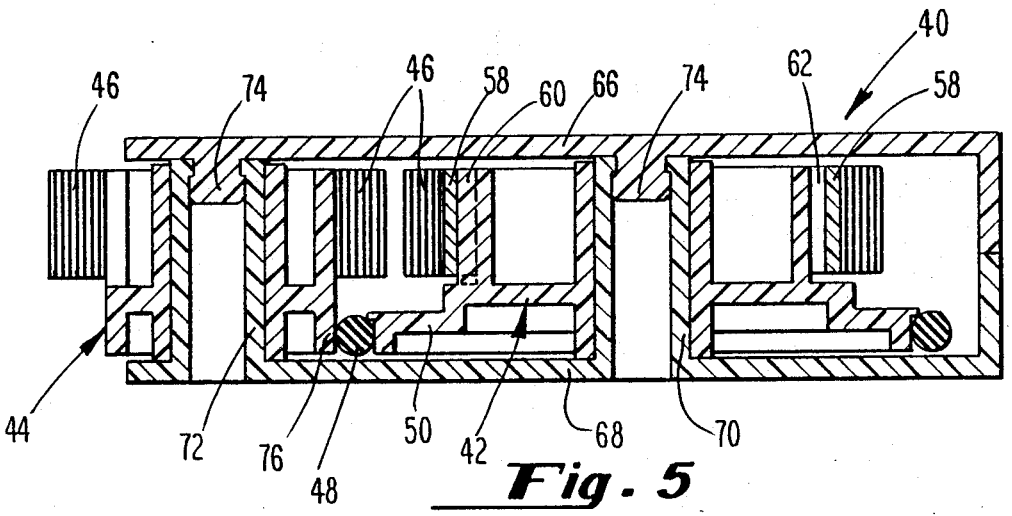
FIG. 5 is a cross-sectional view taken along the line 5—5 of FIG. 4.

FIGS. 4 and 5 illustrate another means by which the take-up reel and supply reel can be engaged for rotation. In this embodiment, the gear drive and the slip clutch are replaced by one element, namely an O-ring or gasket 48. The dispenser includes supply reel 42 and take-up reel 44, with tape 46 being unwound from the supply reel and onto the take-up reel. O-ring 48 is disposed tightly around the supply reel, and is positioned to contact side portion 76 of the take-up reel. The O-ring is fastened around the supply reel with sufficient tightness such that rotation of the O-ring, due to friction with the take-up reel, causes rotation of the supply reel. When the take-up reel rotates in the direction indicated by arrow 54, the supply reel rotates in the direction of arrow 56.

The embodiment of FIGS. 4 and 5 includes means for preventing any slippage between core 58 and supply reel 42. The supply reel has a plurality of projections 60 which mate with indentations 62 in the core. Note that, in the embodiment shown, there are nine indentations in the core, but only four projections on the supply reel. In general, the number of projections and indentations need not be the same, provided that there is at least one projection which mates with a corresponding indentation. FIGS. 4 and 5 thus illustrate a case where not all of the indentations have a corresponding projection. The supply reel may have a full complement of projections, or it may have a smaller number, so as to accommodate different styles of cores.

The structure of the embodiment of FIGS. 4 and 5 is otherwise similar to that of the first-described embodiment. Take-up reel 44 includes slot 64 through which tape 46 can be threaded. The dispenser is disposed in a housing which includes top portion 66 and bottom portion 68. Bottom portion 68 defines bearing 70 around which supply reel 42 rotates, and bearing 72, around which take-up reel 44 rotates. Top portion 66 includes plugs 74 which fit into the bearings. The O-ring 48 engages side portion 76 of take-up reel 44. The tape is not wound around this side portion.

From the point of view of the user, the dispenser of FIGS. 4 and 5 operates in a manner similar to the dispenser shown in FIGS. 1–3. That is, the dispenser is held such that the take-up reel presses firmly against the working surface, and the dispenser is moved along that surface. The take-up reel rotates, depositing the transfer adhesive onto the surface, and pulling additional tape from the supply reel. Due to the difference between the diameter of ring 50 of the supply reel, and that of the take-up reel, the take-up reel tends to pull tape from the supply reel, without developing slack in the tape. To the extent that the take-up reel requires more tape than is allowed by the normal rotation of the supply reel, the two reels slide relative to each other, overcoming the frictional resistance of the O-ring.

The above-described embodiments thus have the advantage of using only two reels instead of three. The take-up reels and applicator rollers of the dispensers of the prior art have been combined into one element. Yet the operation of the dispenser remains automatic, in the sense that the spent tape backing is continuously wound onto the take-up reel, without developing slack.

FIG. 6 shows an alternative embodiment of the invention, wherein the supply reel 90 and take-up reel 92 are connected through a modified gear drive. The modified gear drive allows take-up reel 92 to drive supply reel 90 in one direction only. When the take-up reel rotates in the direction of arrow 94, the supply reel rotates in the direction of arrow 96. But if one attempts to rotate the take-up reel in the direction opposite to that of arrow 94, the reels will lock, and the supply reel does not move by any significant amount.

FIGS. 7*a* and 7*b* illustrate the construction of the modified gear drive in more detail. Gear 98 is connected to take-up reel 92, and gear 100 is connected to supply reel 90. The teeth of gear 98 are modified as will be described below. The teeth of gear 100 are not modified, and preferably have the shape of a standard involute curve.

The sides of the teeth of gear 98 originally have the same shape as those of the teeth of gear 100, i.e. the shape of an involute curve. Every other tooth of gear 98 is partially cut away to form a step, such as step 102. The corresponding sides of the remaining teeth, i.e. the unstepped teeth, are cut away in their entireties. The fact that the entire side of tooth 104 has been cut away is apparent from a visual comparison of tooth 104 of gear 98 with tooth 106 of gear 100. Tooth 106 is wider than tooth 104.

Each step 102 is formed by cutting the tooth along a line which begins at the midpoint of the uncut top land 108 of the tooth, and which line continues along a path generally parallel to the side of the uncut tooth. Thus, the line of cutting has the shape of an involute curve. The position of the step is chosen such that the ratio of the radial distance between the step and the top land, to the entire depth of the tooth (i.e. the radial distance between the top lands 108 and bottom lands 110), is in the range of about 0.33–0.75. The fraction 0.667 (two-thirds) has been found to work especially well, and is what is shown in the drawings.

The teeth which are not formed with steps are cut away along a line of cutting which also begins at the midpoint of the uncut top land, and which continues along a path which is generally parallel to the side of the uncut tooth, until the tooth is cut virtually down to the bottom land 110 between the teeth. The cutting is done on the side which corresponds to the side on which steps are formed on the other teeth. Thus, for example, on tooth 104, it is side 112 which has been cut away. Again, since the cutting is done along a line generally parallel to the uncut side of the tooth, side 112 still has the shape of an involute curve.

When gear 98 rotates in the direction of arrow 114, gear 98 drives gear 100 in the usual manner, and gear 100 rotates in the direction of arrow 116. The steps and cut-away portions of the teeth of gear 98 have no effect when the gears rotate in this direction because the points of engagement of the gear teeth are on the unmodified sides of the teeth.

When one attempts to rotate gear 98 in the opposite direction, given by arrow 118 in FIG. 7*b*, the gears will lock. The reason for this locking is that step 120, of tooth 122 of gear 98, becomes stuck on top land 124 of tooth 126 of gear 100. The locking is also a consequence of the fact that the unstepped teeth of gear 98 have been cut away. For example, because the side of tooth 130 has been cut away, side 128 engages tooth 132 somewhat later than would be the case if the side of tooth 130 had not been cut away. This delayed engagement causes step 120 to become stuck on the top land of the opposite tooth. Thus it is necessary not only that every other tooth of gear 98 have a step, but that all the remaining teeth have a means for delaying engagement with the teeth on the opposite gear. Cutting away of the sides of the teeth is the preferable means of causing this delayed engagement.

It has been shown that gear 98 will drive gear 100 in one direction only. It is also apparent, from FIGS. *7a* and *7b*, that gear 100 can drive gear 98 in either direction. It can also be shown that if gear 100 were modified in the same manner as gear 98, gear 100 would be able to drive gear 98 in only one direction. However, as used in the tape dispenser described herein, gear 100 is not the driving gear, so it is unnecessary to modify gear 100.

In FIG. 6, the gear teeth of take-up reel 92 are located only at the rear end of the reel, and do not extend across the entire width of the reel. This structure contrasts with that of FIGS. 1–3, where the gear teeth extend across the entire width of the reel. However, this difference in structure is not significant. Either embodiment can be constructed in either way, and the design choices shown in the drawings should not be interpreted to limit the invention.

Due to the modified gear structure shown in FIGS. 6 and 7, the take-up reel can rotate the supply reel in only one direction. Thus, if the user accidentally tries to move the take-up reel in the wrong direction, the reels will lock, and neither reel will move by any significant amount. Thus, the invention reduces the likelihood that the tape will unwind and form unwanted loops.

Figure 8:
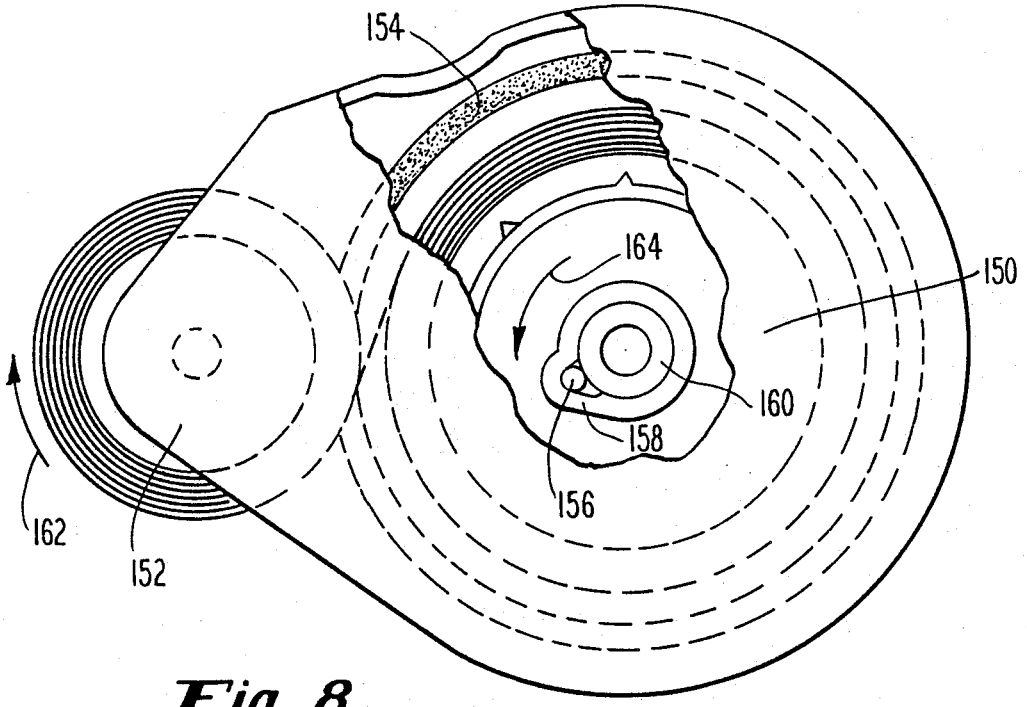
FIG. 8 is a plan view, partly broken away, showing a embodiment wherein the drive means is an O-ring, and wherein a one-way pin prevents the supply reel from rotating in the wrong direction.
Figure 9:
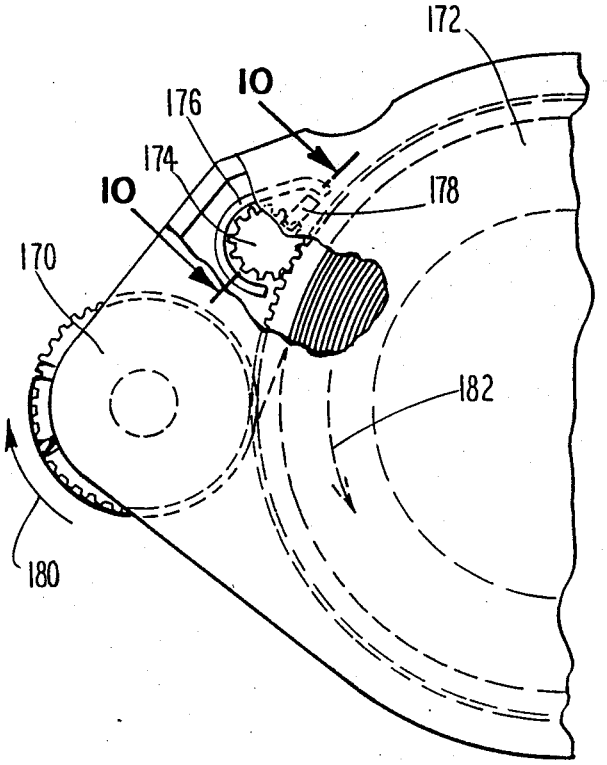
FIG. 9 is a fragmentary plan view, partly broken away, showing an embodiment wherein the drive means is a pair of gears, and wherein a pinion gear prevents the supply reel from rotating in the wrong direction.
Figure 10:
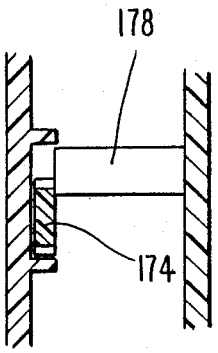
FIG. 10 is a cross-sectional view, taken along the line 10—10 of FIG. 9, showing a retaining means for preventing the pinion gear from escaping from its wedge-shaped restriction.

FIGS. 8–10 show two more embodiments having means for preventing movement of the reels in the undesired direction. In FIG. 8, take-up reel 152 drives supply reel 150 through O-ring 154. One-way pin 156 is held within wedge-shaped restriction 158. The restriction is connected to supply reel 150 and mounted to rotate around spindle 160. When take-up reel 152 rotates in the direction of arrow 162, supply reel 150 rotates in the direction of arrow 164. The one-way pin does not impede this rotation; restriction 158 simply carries the pin with it. However, when one attempts to rotate the take-up reel in the opposite direction, thereby tending to cause the supply reel to rotate in the direction opposite to arrow 164, the pin becomes caught in the narrow portion of the restriction. Due to the friction lock created by the restriction, the supply reel can no longer rotate. Thus, the structure of FIG. 8 effectively prevents the user from rotating the take-up reel in the wrong direction, and prevents undesired unwinding of the tape.

In FIGS. 9 and 10, there is shown a similar structure for use with gear-driven reels. Take-up reel 170 drives supply reel 172 through a gear drive. This gear drive can be of the type shown in FIGS. 1–3, or the modified type of FIGS. 6 and 7. Pinion gear 174 engages the gear of supply reel 172, and is held within restriction 176. Restriction 176 is wedge-shaped, like restriction 158. Retaining protrusion 178 prevents the pinion gear from falling out of restriction 176.

When take-up reel 170 rotates in the direction of arrow 180, supply reel 172 rotates in the direction of arrow 182. The pinion gear does not impede the rotation of the supply reel. But when one attempts to rotate the take-up reel in the other direction, the pinion gear moves towards the narrow portion of restriction 176 and becomes stuck within the restriction. Thus, the pinion gear effectively prevents supply reel 172 from moving in the wrong direction.

While the invention has been described with respect to specific embodiments, it is understood that the dispenser may be modified further, without departing from the general concept of the invention. The structure of the gaskets or gears can be modified, as can the exact location of those items. The gasket in FIGS. 4 and 5 could be located on the take-up reel instead of the supply reel. The slip clutch can be replaced with a clutch of a different structure. The pinion gear or the one-way pin can be connected to the take-up reel, instead of the supply reel, although the embodiment shown is preferred. The one-way pin, instead of the pinion gear, could be used in the embodiment in which the reels are engaged by gears. The modification of the gear teeth of the take-up reel, shown in FIGS. *7a* and *7b*, can also be included on the teeth of the supply reel, though, as stated above, such modification is not necessary. The two-piece housing could be replaced with a single-piece housing. These and other similar changes should be deemed within the spirit and scope of the following claims.

What is claimed is:

1. A dispenser for a transfer adhesive, the dispenser comprising a supply reel, a take-up reel, and a tape of transfer adhesive, the supply reel and the take-up reel being geared together such that rotation of the take-up reel causes rotation of the supply reel, the tape being wound on the supply reel and on the take-up reel, the take-up reel having means for attachment of the tape thereto, the portion of the tape wound on the supply reel being disposed around a core, wherein the supply reel includes slip clutch means for frictional engagement of the supply reel with the core, and wherein the diameter of the supply reel is greater than that of the take-up reel.

2. The dispenser of claim 1, wherein the slip clutch means comprises a plurality of teeth connected to the supply reel, the teeth having heads which are positioned to press against the core.

3. The dispenser of claim 2, wherein the dispenser includes a housing, the housing including first and second portions, wherein one portion of the housing is connected to first and second bearing means, and wherein the supply reel and take-up reel are mounted around said first and second bearing means, respectively.

4. The dispenser of claim 3, wherein the take-up reel and supply reel are connected to gears, and wherein at least one of the gears is modified such that every other tooth of the modified gear is cut away to form a step, and wherein the sides of the remaining teeth of the modified gear include means for delaying engagement with the teeth of another of said gears.

5. The dispenser of claim 3, wherein the take-up reel and supply reel are connected to drive gears, and wherein at least one of the drive gears is connected to a pinion gear, the pinion gear being disposed within a wedge-shaped restriction connected to the housing, wherein the pinion gear rotates normally when the drive gears rotate in a first direction, and wherein the pinion gear becomes stuck in the restriction when the drive gears rotate in the opposite direction.

6. A dispenser for a transfer adhesive, the dispenser comprising a supply reel, a take-up reel, and a tape of transfer adhesive, the supply reel and the take-up reel being disposed to contact a friction drive means, wherein rotation of the take-up reel causes rotation of the supply reel, the tape being wound on the supply reel and on the take-up reel, the take-up reel having means for attachment of the tape thereto, the portion of the tape wound on the supply reel being disposed around a core, and means for attaching the core to the supply reel such that the core does not rotate relative to the supply reel, and wherein the diameter of the supply reel is greater than that of the take-up reel.

7. The dispenser of claim 6, wherein the friction drive means comprises a gasket.

8. The dispenser of claim 7, wherein the gasket is mounted around the supply reel, the gasket being mounted with sufficient tightness such that rotation of the gasket, by friction with the take-up reel, causes rotation of the supply reel.

9. The dispenser of claim 8, wherein the dispenser includes a housing, the housing including first and second portions, wherein one portion of the housing is connected to first and second bearing means, and wherein the supply reel and take-up reel are mounted around said first and second bearing means, respectively.

10. The dispenser of claim 9, wherein one of the reels is connected to a one-way pin, the pin being disposed within a wedge-shaped restriction, wherein the pin permits unimpeded rotation of the reels in a first direction, and wherein the pin becomes stuck in the restriction when the reels rotate in the opposite direction.

11. A dispenser for a transfer adhesive, the dispenser comprising a supply reel and a take-up reel, the supply reel and take-up reels being connected together by a tape and by a connection means which is independent of the tape, such that rotation of the take-up reel causes rotation of the supply reel, wherein the take-up reel comprises means for applying the transfer adhesive to a surface, and wherein the dispenser includes means for maintaining a constant spacing between the centers of the supply reel and take-up reel while the reels are rotating.

12. The dispenser of claim 11, wherein the connection means includes a first gear means on the supply reel, and a second gear means on the take-up reel, and wherein the first and second gear means are disposed for geared engagement with each other.

13. The dispenser of claim 12, wherein at least one of the gear means is modified such that every other tooth of the modified gear means is cut away to form a step, and wherein the sides of the remaining teeth of the modified gear means include means for delaying engagement with the teeth of another of the gear means.

14. The dispenser of claim 12, the dispenser having a housing, wherein at least one of the gear means is connected to a pinion gear, the pinion gear being disposed within a wedge-shaped restriction connected to the housing, wherein the pinion gear rotates normally when the reels rotate in a first direction, and wherein the pinion gear becomes stuck in the restriction when the reels rotate in the opposite direction.

15. The dispenser of claim 11, wherein the connection means comprises a friction drive which connects the supply and take-up reels.

16. The dispenser of claim 15, wherein the friction drive comprises a gasket.

17. The dispenser of claim 16, wherein the gasket is attached around the supply reel with sufficient tightness such that rotation of the gasket, by friction with the take-up reel, causes rotation of the supply reel.

18. The dispenser of claim 17, wherein one of the reels includes a one-way pin, the pin being disposed within a wedge-shaped restriction, the restriction being connected to the reel, wherein the pin permits unimpeded rotation of the reels in a first direction, and wherein the pin becomes stuck in the restriction when the reels rotate in the opposite direction.

19. The dispenser of claim 11, wherein the transfer adhesive comprises a roll of tape wound around a core, and wherein the supply reel includes slip clutch means for frictional engagement of the core with the supply reel.

20. The dispenser of claim 19, wherein the slip clutch means includes a plurality of teeth, connected to the supply reel, the teeth having means for frictional engagement with the core.

21. The dispenser of claim 11, wherein the transfer adhesive comprises a roll of tape wound around a core, wherein the core and the supply reel include means for preventing relative rotation of the core and the supply reel.

22. A dispenser for a transfer adhesive, the dispenser comprising a supply reel and a take-up reel, the supply reel and take-up reels being geared together such that rotation of the take-up reel causes rotation of the supply reel, and a roll of transfer adhesive tape, the tape being wound on the supply reel and onto the take-up reel, wherein the take-up reel comprises means for applying the transfer adhesive to a surface, and wherein the dispenser includes means for maintaining a constant spacing between the centers of the supply reel and take-up reel while the reels are rotating.

23. The dispenser of claim 22, wherein the take-up reel includes means for attaching the tape to the take-up reel.

24. The dispenser of claim 22, wherein the supply reel includes clutch means, the clutch means comprising means for preventing relative rotation of the roll of tape and the supply reel when the tape is not being pulled from the roll, the clutch means permitting relative movement of the roll relative to the supply reel when the tape is being pulled from the roll.

25. The dispenser of claim 24, wherein the clutch means comprises at least one resilient member connected to the supply reel, the resilient member being disposed to abut at least a portion of the roll of tape.

26. The dispenser of claim 25, wherein the resilient member comprises a plurality of resilient teeth.

27. A dispenser for a transfer adhesive, the dispenser comprising a supply reel and a take-up reel, the supply reel and take-up reels being connected to gears which are engaged with each other such that rotation of the take-up reel causes rotation of the supply reel, a roll of transfer adhesive tape, the tape being wound on the supply reel and onto the take-up reel, wherein the take-up reel comprises means for applying the transfer adhesive to a surface, the teeth of the gear connected to the take-up reel being modified such that every other tooth is cut away to define a step, and such that the unstepped teeth are cut away so as to delay engagement with the teeth of the supply reel, wherein the take-up reel can drive the supply reel in only one direction.

28. A dispenser for a transfer adhesive, the dispenser comprising a supply reel and a take-up reel, the supply reel and take-up reels being connected to gears which are engaged with other such that rotation of the take-up reel causes rotation of the supply reel, a roll of transfer adhesive tape, the tape being wound on the supply reel and onto the take-up reel, wherein the take-up reel comprises means for applying the transfer adhesive to a surface, the dispenser including a housing, the gear of the supply reel being connected to a pinion gear disposed within a wedge-shaped restriction, the restriction being connected to the housing, wherein the pinion gear can rotate normally when the supply reel rotates in a first direction, and wherein the pinion gear becomes stuck in the wedge-shaped restriction when the supply reel rotates in the opposite direction.

29. A dispenser for a transfer adhesive, the dispenser comprising a supply reel and a take-up reel, the supply reel and take-up reels being engaged with each other through a friction drive, such that rotation of the take-up reel causes rotation of the supply reel, a roll of transfer adhesive tape, the tape being wound on the supply reel and onto the take-up reel, wherein the take-up reel comprises means for applying the transfer adhesive to a surface, wherein the supply reel includes a one-way pin, the pin being disposed within a wedge-shaped restriction connected to the supply reel, wherein the pin permits unimpeded rotation of the reels in a first direction, and wherein the pin becomes stuck in the restriction when the reels rotate in the opposite direction.

30. A dispenser for a transfer adhesive, the dispenser comprising a supply reel and a take-up reel, the supply reel and take-up reels being engaged such that rotation of the take-up reel causes rotation of the supply reel, a roll of transfer adhesive tape, the tape being wound on the supply reel and onto the take-up reel, the take-up reel comprising means for applying the transfer adhesive to a surface, the dispenser including means for maintaining a constant spacing between the centers of the supply reel and take-up reel while the reels are rotating, and means for preventing at least one of the reels from rotating in one direction, and for permitting the reels to rotate in the opposite direction.

31. The dispenser of claim 30, wherein the rotation preventing means comprises means for preventing the supply reel from rotating in one direction.

32. The dispenser of claim 31, wherein the reels are connected by gears, and wherein the rotation preventing means comprises a plurality of steps and cut-away portions formed on the teeth of at least one of said gears.

33. The dispenser of claim 31, wherein the rotation preventing means comprising pin means disposed within a restriction means, the restriction means being connected to one of the reels, the restriction means being shaped such that the pin means becomes caught within the restriction means when the reels rotate in the undesired direction.

34. A dispenser for a transfer adhesive, the dispenser comprising a supply reel and a take-up reel, the supply reel and take-up reels being connected together such that rotation of the take-up reel causes rotation of the supply reel, wherein the take-up reel comprises means for applying the transfer adhesive to a surface, wherein the supply reel includes a first gear means, and wherein the take-up reel includes a second gear means, wherein the first and second gear means are disposed for geared engagement with each other, wherein at least one of the gear means is modified such that every other tooth of the modified gear means is cut away to form a step, and wherein the sides of the remaining teeth of the modified gear means include means for delaying engagement with the teeth of another of the gear means.

35. A dispenser for a transfer adhesive, the dispenser comprising a supply reel and a take-up reel, the supply reel and take-up reels being connected together such that rotation of the take-up reel causes rotation of the supply reel, and wherein the take-up reel comprises means for applying the transfer adhesive to a surface, wherein the supply reel includes a first gear means, and wherein the take-up reel includes a second gear means, and wherein the first and second gear means are disposed for geared engagement with each other, the dispenser having a housing, wherein at least one of the gear means is connected to a pinion gear, the pinion gear being disposed within a wedge-shaped restriction connected to the housing, wherein the pinion gear rotates normally when the reels rotate in a first direction, and wherein the pinion gear becomes stuck in the restriction when the reels rotate in the opposite direction.

36. A dispenser for a transfer adhesive, the dispenser comprising a supply reel and a take-up reel, the supply reel and take-up reels being connected together such that rotation of the take-up reel causes rotation of the supply reel, and wherein the take-up reel comprises means for applying the transfer adhesive to a surface, wherein the transfer adhesive comprises a roll of tape wound around a core, and wherein the supply reel includes slip clutch means for frictional engagement of the core with the supply reel.

37. The dispenser of claim 36, wherein the slip clutch means includes a plurality of teeth, connected to the supply reel, the teeth having means for frictional engagement with the core.

* * * * *